US009639110B1

(12) United States Patent
Bruhis

(10) Patent No.: US 9,639,110 B1
(45) Date of Patent: May 2, 2017

(54) ELASTIC FORCE TRANSDUCER

(71) Applicant: BG Systems, Inc., Palo Alto, CA (US)

(72) Inventor: Ofer Bruhis, Palo Alto, CA (US)

(73) Assignee: BG Systems, Inc., Palo Alto, CA (US)

( * ) Notice: Subject to any disclaimer, the term of this patent is extended or adjusted under 35 U.S.C. 154(b) by 59 days.

(21) Appl. No.: 14/206,805

(22) Filed: Mar. 12, 2014

Related U.S. Application Data

(60) Provisional application No. 61/784,785, filed on Mar. 14, 2013.

(51) Int. Cl.
*G05G 1/04* (2006.01)
*G05G 9/047* (2006.01)

(52) U.S. Cl.
CPC ..... *G05G 1/04* (2013.01); *G05G 2009/04725* (2013.01)

(58) Field of Classification Search
CPC ..... G05G 2009/04725; G05G 1/04
See application file for complete search history.

(56) References Cited

U.S. PATENT DOCUMENTS 1,865,697 A * 7/1932 Karrer ..... G05G 9/04785 200/15
4,876,524 A * 10/1989 Jenkins ..... G01L 1/225 338/2
2008/0288093 A1* 11/2008 Kamentser ..... G05G 9/047 700/85

* cited by examiner

*Primary Examiner* — Terence Boes
(74) *Attorney, Agent, or Firm* — Van Pelt, Yi & James LLP

(57) ABSTRACT

An input device is disclosed. In various embodiments, the input device includes a spring having a free end and a fixed end. A force transducer having a transducer beam is coupled to the free end of the spring in a manner such that a free end of the transducer beam extends away from the free end of the spring.

9 Claims, 6 Drawing Sheets

ELASTIC FORCE TRANSDUCER

CROSS REFERENCE TO OTHER APPLICATIONS

This application claims priority to U.S. Provisional Patent Application No. 61/784,785 entitled ELASTIC FORCE TRANSDUCER filed Mar. 14, 2013 which is incorporated herein by reference for all purposes.

BACKGROUND OF THE INVENTION

Joysticks and other hand-operated controllers, for example, may include a knob or other input device that can be operated by a thumb or other finger to control, for example, a cursor or other user interface element based on the motion (displacement) of the control device. For example, moving the knob forward or back may move a cursor up or down, or moving the knob left or right may move the cursor left or right.

In a typical joystick or similar hand-operated controllers, an input is determined by using magnetic or other position sensors to sense a position to which the joystick or other actuator has been moved within a housing.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention.

Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A force transducer adapted to be used to detect displacement is disclosed. In various embodiments, joysticks and/or other hand-operated controls are provided which include input devices that generate electrical output based on the motion (e.g., displacement), but using sensors that are affected by force applied (transducer).

Figure 1A:
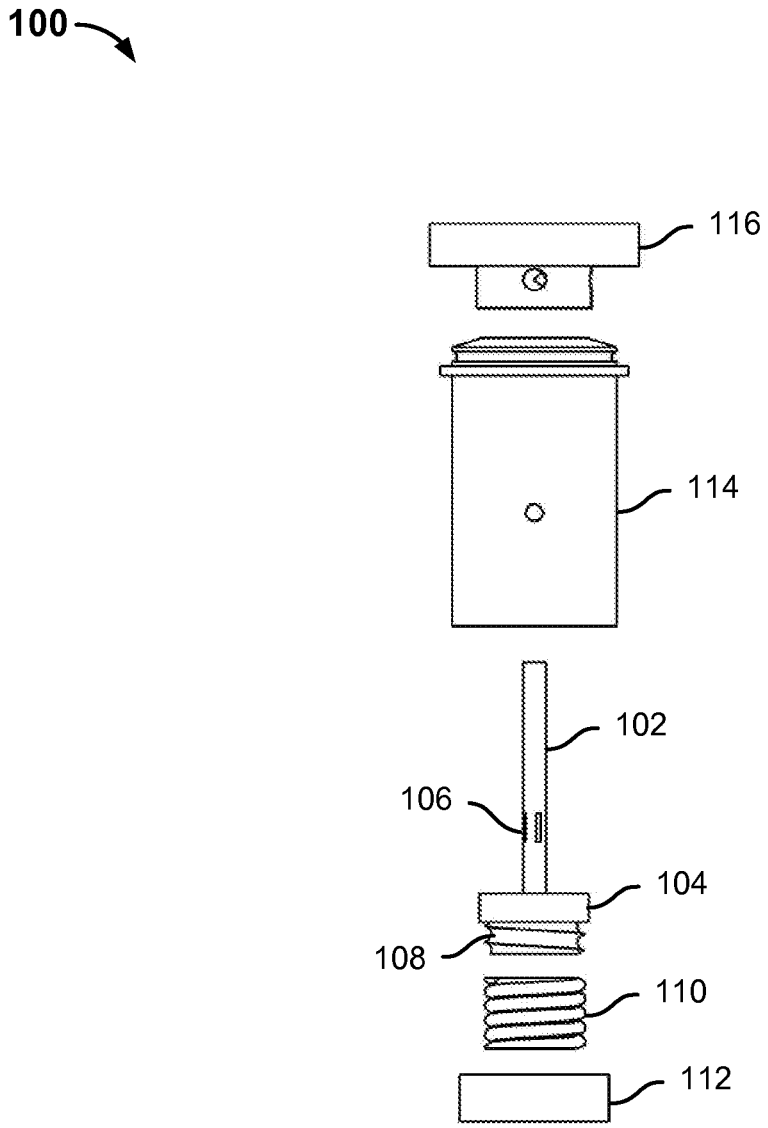
FIGS. 1A and 1B are block diagrams illustrating views of an embodiment of a manually-operated input device based on a force transducer.
Figure 1B:
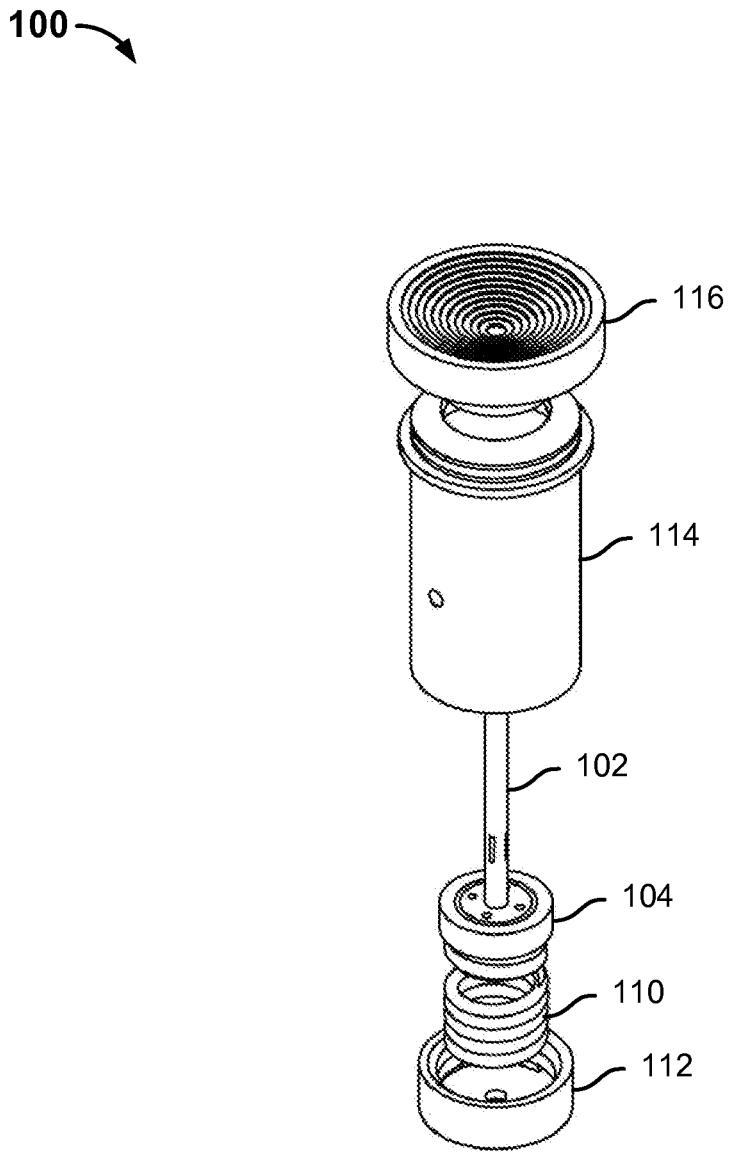

FIGS. 1A and 1B are block diagrams illustrating views of an embodiment of a manually-operated input device based on a force transducer. In the example shown, input device 100 includes a transducer beam 102 mounted on a transducer base assembly 104. A set of strain gauges 106 is mounted on the transducer beam 102. A strain gauge is a device used to measure strain (very small deflection) of an object. In some embodiments, each of strain gauges 106 comprises a small resistor that is attached to a transducer beam 102, which in various embodiments may be made of metal. As the metal deforms, the gauge follows it and changes its resistance, enabling a voltage proportional to or otherwise representative of an amount of force that has been applied to the transducer beam to be provided as output of the force transducer. In various embodiments, strain gauges 106 comprise a Wheatstone bridge circuit and are positioned such that a direction and magnitude of a force that has been applied to the force may be derived.

In the example shown in FIGS. 1A and 1B, the transducer beam 102 is mounted on transducer base 104, which in this example has (or is attached rigidly to a structure having) threads 108 on an end opposite the transducer beam 102, which enables the transducer beam/base assembly (102, 104, 106, 108) to be attached to spring 110 by screwing the transducer beam/base assembly into spring 110. The other end of spring 110 is attached to another fixture 112 which attaches to a casing (not shown) or other external rigid structure. In the example shown, the fitting 112 has internal threads that enable the spring 110 to be screwed into the fixture 112.

A housing 114 covers the transducer assembly (102, 104, 106, 108, and 110) while leaving the transducer beam 102 to be moved laterally within the housing 114, in this example by application of force, using a thumb or finger for example, to a knob 116 attached rigidly to an upper end of transducer beam 102, one or both of transducer beam 102 and knob 116 extending through an opening on the upper end of housing 114 in a manner that enables the mechanically coupled knob 116 and transducer beam 102 assembly to be moved laterally within a range of motion defined by a size and shape of the opening on the upper end of housing 114, e.g., a round opening in the example shown in FIGS. 1A and 1B.

In various embodiments, the spring 110 acts as an elastic (flexible) connecting agent between a casing or other structure to which fixture 112 is attached, on the one hand, and the transducer beam 102 on the other. In various embodiments, one or both of the stiffness and the initial tension of the spring 110 are tuned to achieve the result that the electrical output of the force transducer will peak when the transducer hits a hard stop of a structure into and/or with which the elastic force transducer is integrated, such as housing 114.

While in the example shown in FIGS. 1A and 1B, a coil spring 110 is used, in other embodiments other types of spring may be used. The spring may be tuned and/or selected, as appropriate, in various embodiments, to achieve the result that the electrical output of the transducer will peak when the transducer hits a hard stop of a casing or other structure within which the transducer is mounted. In various embodiments, tuning spring 110 may include selecting one or more of the following: coil width (diameter), number of coils, wire thickness, wire material, and pretension.

Figure 2A:
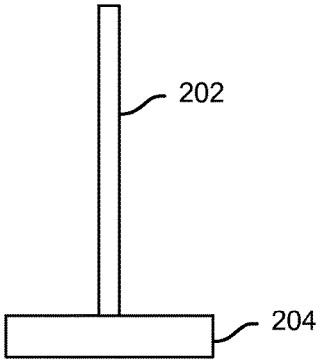
FIG. 2A is a block diagram illustrating an embodiment of a force transducer.

FIG. 2A is a block diagram illustrating an embodiment of a force transducer. In the example shown in FIG. 2A, the force transducer includes a transducer beam 202 mounted on a transducer base 204.

Figure 2B:
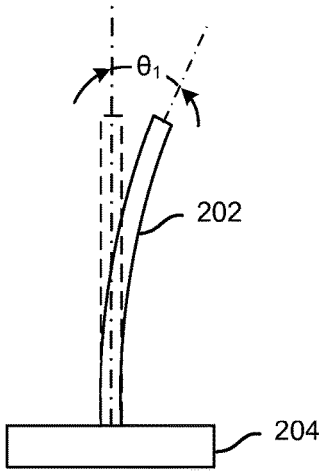
FIG. 2B is a block diagram illustrating the force transducer of FIG. 2A in a state in which force has been applied to a transducer beam of the force transducer.

FIG. 2B is a block diagram illustrating the force transducer of FIG. 2A in a state in which force has been applied to a transducer beam of the force transducer. In the example shown, a force has been applied laterally (in this example, left to right) resulting in the transducer beam being deflected to the right by an angle $\theta_1$.

Typically, the maximum actual deformation of the metal (relative to the length of the transducer beam), i.e., when a force corresponding to maximum transducer output (voltage) is applied, is on the order of 1-3%. If the metal were to deform more (due to excessive force), the gauge may break, or the metal may exceed its elastic properties into the plastic domain and never return to its original shape. As an example, the typical deflection for a 25 mm beam is about 0.2-0.5 mm.

Figure 3A:
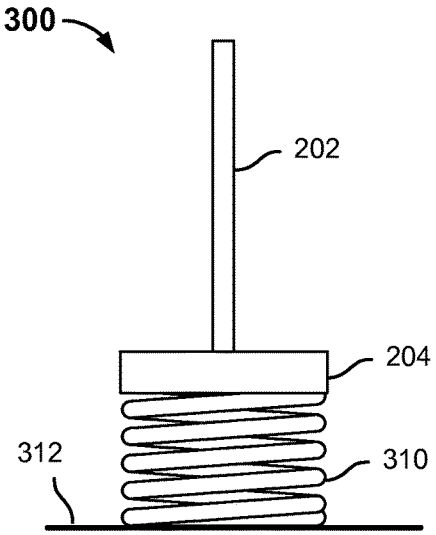
FIG. 3A is a block diagram illustrating an embodiment of an elastic force transducer.

FIG. 3A is a block diagram illustrating an embodiment of an elastic force transducer. In the example shown, the elastic force transducer 300 includes the same transducer beam 202 and base 204 as shown in FIG. 2, but attached more or less rigidly to a spring 310 mounted to a casing or other structure 312.

Figure 3B:
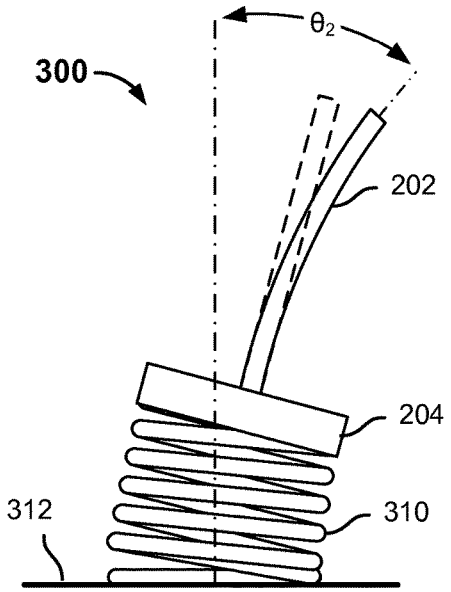
FIG. 3B is a block diagram illustrating the elastic force transducer of FIG. 3A in a state in which force has been applied to a transducer beam of the elastic force transducer.

FIG. 3B is a block diagram illustrating the elastic force transducer of FIG. 3A in a state in which force has been applied to a transducer beam of the elastic force transducer. In particular, in this example a force that is of the same (maximum) magnitude as in the example shown in FIG. 2B is applied. As illustrated in FIG. 3B, the integration of the transducer assembly (202, 204) with the spring 310 provides an elastic force transducer 300 that moves, in response to the same force being applied in the example in FIG. 2B, through a much greater flexible range, as indicated by the angle $\theta_2$ as shown in FIG. 3B, than for the same force transducer (202, 204) when not mounted on a spring such as spring 310, e.g., as shown in FIGS. 2A and 2B. In various embodiments, by mounting a force transducer on a spring, as shown in FIGS. 3A and 3B for example and without limitation, additional elasticity up to 25% of actual transducer beam length may be achieved. As an example, in the case of a 25 mm beam, deflection may be 6-9 mm (up to 40-50 times larger than the original beam not mounted on a spring).

Figure 4:
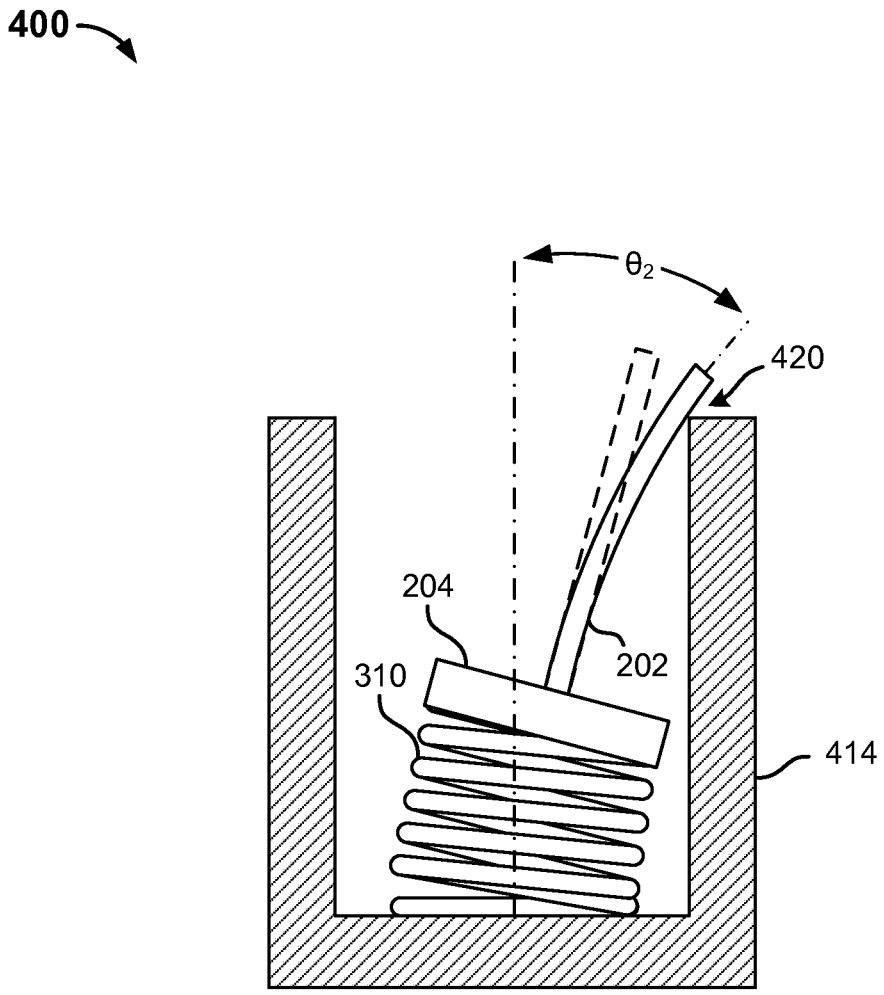
FIG. 4 is a block diagram illustrating an elastic force transducer mounted in a housing.

FIG. 4 is a block diagram illustrating an elastic force transducer mounted in a housing. In the example shown, the elastic force transducer of FIGS. 3A and 3B (202, 204, 310) is mounted in a housing 414. As shown, force has been applied to transducer beam 202 resulting in a degree of deformation of beam 202 corresponding to maximum output of the force transducer being achieved at a point at which the beam 202 just makes contact with the housing 414 at a point of contact 420. In this way, positions of the beam may be detected by monitoring the transducer output level (voltage), which may vary (e.g., linearly or nearly linearly) from zero (corresponding to the neutral or vertical position in this example) to a maximum value (corresponding the position as shown in FIG. 4), enabling a much greater range of physical (e.g., lateral) motion being made possible than if the force transducer were rigidly mounted, as in the example shown in FIGS. 2A and 2B.

The output of the transducer (direction and magnitude) are mapped in various embodiments to corresponding inputs to control, for example, cursor movement including direction and speed of movement, with greater displacement of the input device (e.g., higher deflection of the force transducer as the beam or housing approaches the hard stop) resulting in some embodiments in more rapid movement of the cursor in the corresponding direction on the display device.

In various embodiments, techniques disclosed herein also provide more resolution, because from a human factor point of view, a human operator typically is able to control the amount of force applied when there is some movement associated with it, i.e., a greater and more readily perceptible range of movement (displacement) than a traditional force transducer not mounted on a spring or other flexible member, as disclosed herein.

Figure 5:
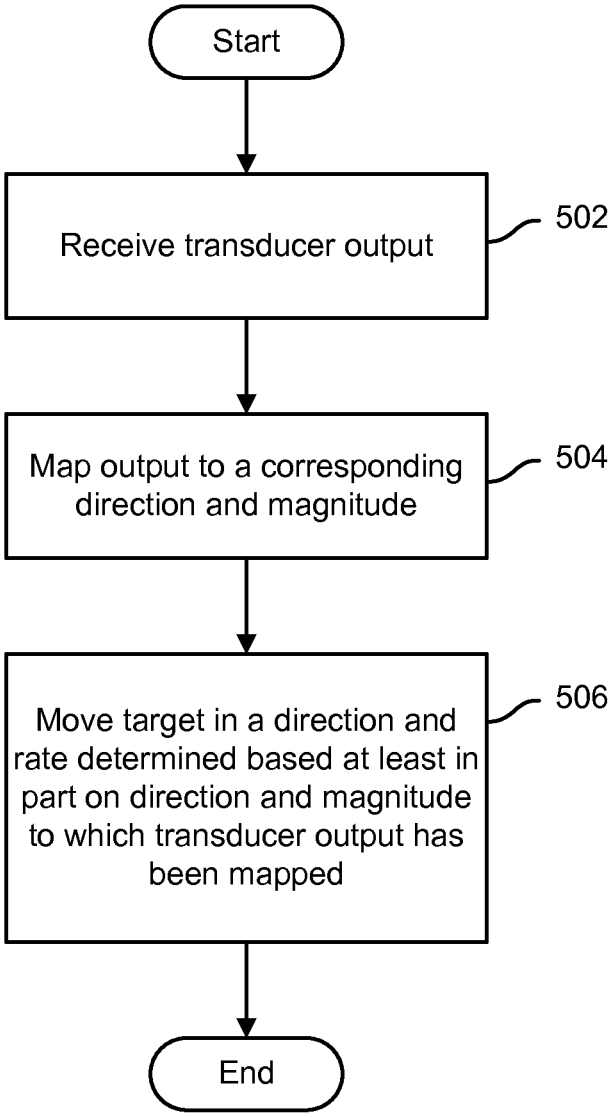
FIG. 5 is a flow chart illustrating an embodiment of a process to use output of an elastic force transducer-based input device to control movement of a target.

FIG. 5 is a flow chart illustrating an embodiment of a process to use output of an elastic force transducer-based input device to control movement of a target. In the example shown, output provided by the force transducer is received (502). For example, respective voltages representing force components as applied in each of an X and a Y direction, respectively, may be received. The force transducer output is mapped to a corresponding direction (e.g., in which the free end of the elastic transducer assembly's transducer beam has been moved) and magnitude (e.g., a magnitude associated with a position to which the free end of the elastic transducer assembly's transducer beam has been moved, such as from a vertical or other neutral position) (504). For example, if the transducer output indicates the free end of the beam was moved in a Y direction to a position about half way between the neutral position and a physical stop corresponding to a maximum force transducer output, in some embodiments the force transducer output would be mapped to the Y direction (no X direction component in this example) and a magnitude corresponding to ½ a maximum magnitude. A target that is being controlled using an input device comprising the elastic force transducer would be moved in a manner that is based at least in part on the determined direction and magnitude (506). For example, in the example mentioned above, in the case of an elastic force transducer comprising a joystick provided to control movement of a cursor in the context of a display, the cursor may be moved in the Y direction at a rate that is ½ a maximum cursor movement rate.

Figure 6A:
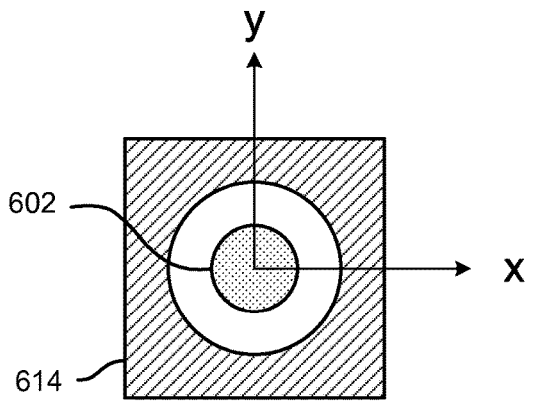
FIG. 6A is a block diagram illustrating an embodiment of an elastic force transducer-based input device.

FIG. 6A is a block diagram illustrating an embodiment of an elastic force transducer-based input device. In the example shown, the input device includes a transducer beam 602 positioned within a housing 614 in a manner that provides freedom of movement within a circular opening of housing 614.

Figure 6B:
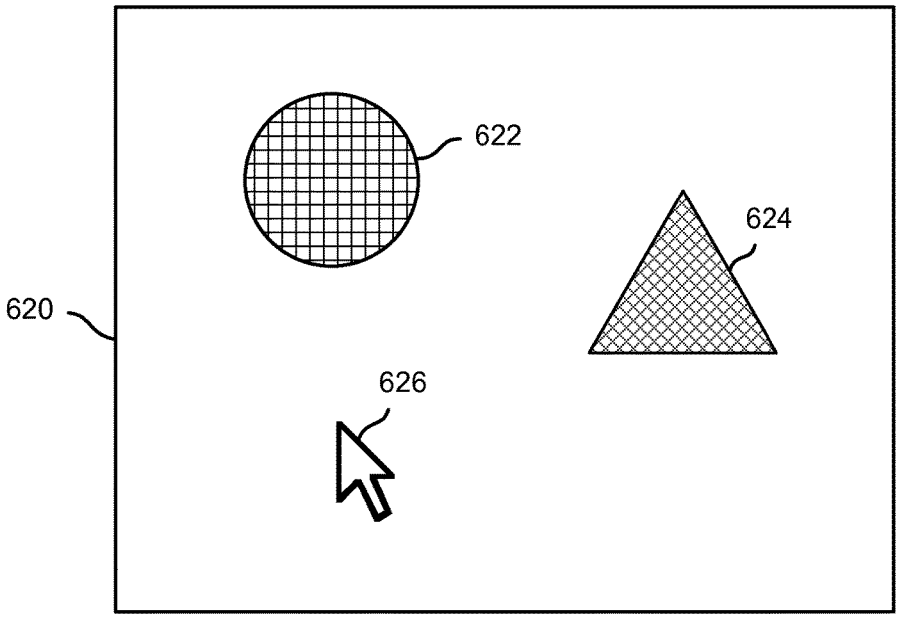
FIG. 6B is a block diagram illustrating an embodiment of a display in which the position and/or movement of a cursor is controlled using an elastic force transducer-based input device, such as shown in FIG. 6A.

FIG. 6B is a block diagram illustrating an embodiment of a display in which the position and/or movement of a cursor is controlled using an elastic force transducer-based input device, such as shown in FIG. 6A. In the example shown, the display 620 includes selectable objects 622 and 624 and a cursor 626. In various embodiments, the cursor 626 may be moved to a new position within display 620 by providing an input using an input device that comprises an elastic force transducer as disclosed herein. For example, to move the cursor up to the position of object 622 as shown, the beam 602 of the input device shown in FIG. 6A may be pushed in the Y direction to a position between the neutral position shown in FIG. 6A and a maximum position at which the beam 602 would contact the housing 614, for example, with the position within said range of motion in the Y direction being used to determine how fast the cursor would be moved through display 620 in the Y direction. Likewise, to move cursor 626 to the location of selectable object 624, the input device of FIG. 6A may be used to provide an input that causes the cursor 626 to move more quickly in the X direction that the Y direction, for example by moving the beam 602 within the opening in housing 614 to a position that has a greater X direction component than Y direction component.

In various embodiments, as described herein, a force sensor is used to measure displacement of the transducer beam or other member within a range of motion, and not force.

While in a number of examples described herein an elastic force transducer as disclosed herein is used to control the position and/or movement of a cursor within a display, cursor control is only an example of ways in which an input device comprising an elastic force transducer may be used. In various embodiments an input device comprising an elastic force transducer may be used to control any target system, device, or other element, for example, and without limitation, a robotic arm, a control surface of an aircraft, vessel, or ground vehicle, a computer graphic, game, animation, or other displayed character, etc.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An input device, comprising:

a spring having a free end and a fixed end;

a force transducer having a transducer beam, the force transducer being coupled to the free end of the spring in a manner such that a free end of the transducer beam extends away from the free end of the spring, and a set of strain gauges mounted on the transducer beam and configured to provide an output signal representative of a force applied laterally at or near said free end of the transducer beam;

wherein the set of strain gauges has a peak output value associated with a maximum transducer beam deformation associated with a first angular displacement $\theta_1$ of said transducer beam relative to a longitudinal axis of the transducer beam; and wherein said spring has one of more spring properties that result in the peak output value being produced by the set of strain gauges when the free end of the transducer beam is displaced from the longitudinal axis by a second angular displacement $\theta_2$ that is an order of magnitude greater than the first angular displacement $\theta_1$.

2. The input device of claim 1, wherein the spring comprises a coil spring.

3. The input device of claim 1, wherein the one or more spring properties include one or more of the following: coil diameter, number of coils, wire thickness, and pretension.

4. The input device of claim 1, wherein the second angular displacement corresponds to a physical stop that physically prevents the transducer beam from being moved beyond the second angular displacement.

5. The input device of claim 4, wherein the input device further comprises a housing and the physical stop comprises a portion of the housing.

6. The input device of claim 5, wherein the housing at least partly encloses one or both of the spring and the force transducer and the portion of the housing comprises an opening through which at least a portion of the free end of the transducer beam extends.

7. The input device of claim 1, wherein the first angular displacement corresponds to a lateral deflection of approximately 1-3% of a length of the transducer beam.

8. The input device of claim 7, wherein the second angular displacement corresponds to a lateral deflection of approximately 25% of the length of the transducer beam.

9. The input device of claim 1, wherein the transducer beam is threaded at a base end opposite the free end of the transducer beam and the force transducer is coupled to the spring at least in part by screwing the threaded base end into or onto the spring.

* * * * *